US008136276B2

(12) United States Patent
O'Neill

(10) Patent No.: US 8,136,276 B2
(45) Date of Patent: Mar. 20, 2012

(54) APPARATUS FOR PRODUCING AN OPTICAL EFFECT

(75) Inventor: Noel O'Neill, Drogheda (IE)

(73) Assignee: Basic Holdings, Dublin (IE)

( * ) Notice: Subject to any disclaimer, the term of this patent is extended or adjusted under 35 U.S.C. 154(b) by 0 days.

(21) Appl. No.: 11/575,118

(22) PCT Filed: Sep. 12, 2005

(86) PCT No.: PCT/EP2005/009774

§ 371 (c)(1),
(2), (4) Date: Mar. 12, 2007

(87) PCT Pub. No.: WO2006/027272

PCT Pub. Date: Mar. 16, 2006

(65) Prior Publication Data

US 2008/0028648 A1 Feb. 7, 2008

(30) Foreign Application Priority Data

Sep. 10, 2004 (GB) ..... 0420131.5

(51) Int. Cl.
*G09F 19/00* (2006.01)

(52) U.S. Cl. ..... 40/428; 472/65

(58) Field of Classification Search ..... 40/428; 472/65

See application file for complete search history.

(56) References Cited

U.S. PATENT DOCUMENTS

| | | | | |
|---|---|---|---|---|
| 1,432,942 | A | 10/1922 | Zei et al. | |
| 1,827,941 | A | 10/1931 | Gross | |
| 3,395,476 | A * | 8/1968 | Moss et. al. | 40/428 |
| 4,965,707 | A | 10/1990 | Butterfield | |
| 5,572,817 | A | 11/1996 | Chien | |
| 5,612,266 | A | 3/1997 | Delvaux et al. | |
| 5,642,580 | A | 7/1997 | Hess et al. | |
| 5,989,128 | A | 11/1999 | Baker et al. | |
| 6,551,726 | B1 | 4/2003 | Burrows | |
| 6,688,752 | B2 | 2/2004 | Moore | |
| 6,988,820 | B2 | 1/2006 | Drufva | |
| 2002/0152655 | A1 | 10/2002 | Merrill et al. | |
| 2003/0041491 | A1 | 3/2003 | Mix | |
| 2005/0097792 | A1 * | 5/2005 | Naden | 40/428 |

FOREIGN PATENT DOCUMENTS

| | | |
|---|---|---|
| CA | 2321716 | 9/1999 |
| CN | 1410705 A | 4/2003 |
| DE | 4142320 | 7/1992 |
| EP | 0170521 | 2/1986 |
| EP | 0194157 | 9/1986 |
| EP | 0897514 | 2/1999 |

(Continued)

OTHER PUBLICATIONS

International Search Report and Written Opinion for PCT Application No. PCT/EP2005/009774 dated Jan. 2, 2006.

(Continued)

*Primary Examiner* — Joanne Silbermann
(74) *Attorney, Agent, or Firm* — Kusner & Jaffe

(57) ABSTRACT

The present invention relates to apparatus for producing an optical effect, and in particular to an apparatus for producing an optical effect resembling flames and smoke. More especially, the invention relates to flame effect electric fires, such as for domestic use, which may or may not include means for space heating and which include and optical effect to resemble burning solid fuel.

24 Claims, 3 Drawing Sheets

FOREIGN PATENT DOCUMENTS

| | | | | |
|---|---|---|---|---|
| EP | 0897514 | B1 | * | 2/1999 |
| FR | 2846562 | | | 5/2004 |
| GB | 108097 | | | 7/1917 |
| GB | 417413 | | | 10/1934 |
| GB | 2232481 | | | 12/1990 |
| GB | 2242736 | | | 10/1991 |
| GB | 2256040 | | | 11/1992 |
| GB | 2256040 | A | * | 11/1992 |
| GB | 2391933 | | | 2/2004 |
| GB | 2395131 | | | 5/2004 |
| GB | 2402206 | | | 12/2004 |
| JP | 11162651 | | | 6/1999 |
| WO | WO 99/45326 | | | 9/1999 |
| WO | 0157447 | | | 8/2001 |
| WO | WO 01/57447 | A1 | * | 8/2001 |
| WO | 02099338 | | | 12/2002 |
| WO | 03063664 | | | 8/2003 |
| WO | WO 03/063664 | A1 | * | 8/2003 |
| WO | WO 2006/027272 | | | 3/2006 |
| WO | WO 2007/104532 | | | 9/2007 |

OTHER PUBLICATIONS

Search Report for British Application No. GB0403601.8 dated Jun. 29, 2004.

International Search Report for PCT Application No. PCT/EP2005/001668 dated Jul. 5, 2005.

International Search Report for PCT Application No. PCT/EP2005/009776 dated Dec. 16, 2005.

International Search Report and Written Opinion for PCT Application No. PCT/EP2005/007179 dated Nov. 3, 2006.

Search Report for British Application No. GB0403601.8 dated Oct. 5, 2007.

International Search Report for PCT Application No. PCT/EP2007/002207 dated Dec. 6, 2007.

Search Report for related British Application No. GB0420131.5 dated Dec. 23, 2004.

Notification of the First Office Action for related Chinese Application No. 200580038297.X dated Aug. 29, 2008.

Notification of the Third Office Action issued by the Patent Office of the People's Republic of China dated Apr. 22, 2010 for related Chinese Application No. 200580038297.X.

* cited by examiner

APPARATUS FOR PRODUCING AN OPTICAL EFFECT

BENEFIT CLAIMS

This application is a US National Stage of International Application No. PCT/EP2005/009774, filed 12 Sep. 2005, which claims the benefit of GB 0420131.5, filed 10 Sep. 2004.

The present invention relates to apparatus for producing an optical effect, and in particular to an apparatus for producing an optical effect resembling flames and smoke. More especially, the invention relates to flame effect electric fires, such as for domestic use, which may or may not include means for space heating and which include and optical effect to resemble burning solid fuel.

Fuel and flame effect fires in which burning solid fuel is simulated are well known. An example is described in GB 2 230 335. Typically a flame effect fire will comprise a simulated fuel bed comprising simulated fuel and embers. The simulated fuel bed may be an integral thermoplastic moulding which is shaped and coloured to resemble both pieces fuel and the ember bed on which the fuel rests. Alternatively, the fuel bed may comprise a separate thermoplastic moulding intended to resemble only the ember bed on which discrete simulated fuel pieces are laid. The fuel bed is generally illuminated from below, to give the glowing effect of burning fuel pieces. For simulating the appearance of flames a screen is mounted behind the fuel bed. The screen may be partially reflective on its front surface to provide a virtual image of the fuel bed. The screen is also transmissive of light when illuminated from behind and may be partially diffusing of such light. The illusion of flames is provided by suitable modification of light from a light source which falls on the rear surface of the screen. GB 2 230 335 and EP 0 897 514 teach such arrangements.

Many of the prior art arrangements for simulating the fuel and flames of a solid fuel fire provide a very pleasant, interesting and realistic effect, but there remains room for improvement. More especially, many of the prior art arrangements provide a flame effect which is perceived to be essentially two-dimensional and it would be desirable to provide an effect which is perceived to be more three dimensional, hence achieving greater realism.

Accordingly, the present invention seeks to provide an apparatus, such as a fire or stove, having a simulated fuel and/or flame effect which may be perceived to be superior to those of the prior art, and also to provide a fuel and/or flame effect for use in such apparatus.

According to a first aspect of the invention, there is provided a simulated burning fuel apparatus comprising:

a simulated fuel bed;

at least one aperture;

at least one light source;

a source of simulated smoke;

means for conveying the simulated smoke from said source through said aperture or apertures, so that the smoke rises from said aperture or apertures;

said light source operatively selectively and/or locally illuminating the rising smoke to provide the illusion of flames.

Preferably the apparatus further comprises a closed chamber within which the fuel bed, the conveying means and at least one light source are arranged.

Preferably the apparatus further comprises means for recirculating the simulated smoke.

Preferably the closed chamber further comprises an inner compartment within which the fuel bed is mounted, the inner compartment being defined by at least one wall extending within the closed chamber, said wall including at least one smoke inlet aperture and at least one smoke outlet aperture.

Preferably a void is defined between at least one wall of the closed chamber and the inner compartment, the void providing a path for circulation of the simulated smoke from the outlet aperture to the inlet aperture.

Preferably the means for conveying the simulated smoke is disposed outside the inner compartment.

Preferably the means for conveying the simulated smoke is at least one fan.

In one preferred embodiment, the source of simulated smoke is disposed proximate the inlet aperture of the inner compartment.

Preferably the source of simulated smoke is sealably mounted on an external face of a wall of the closed chamber, said wall including an aperture arranged proximate the inlet aperture of the inner compartment for entry of simulated smoke into the closed chamber and preferably also the inner compartment.

Preferably the simulated fuel bed comprises a plastic moulding shaped and coloured to resemble an ember bed, apertures being formed in the said plastic moulding and so located as not to be visible to a user in normal use of the apparatus.

Preferably the plastic moulding is shaped and coloured to resemble both an ember bed and pieces of fuel on the ember bed.

In a more preferred arrangement the simulated fuel bed includes discrete pieces of simulated fuel. Preferably the discrete pieces of simulated fuel are arranged on a simulated ember bed which preferably comprises a shaped and coloured plastic moulding.

Preferably said apertures are formed in the simulated ember bed.

Preferably further apertures, channels, passages or voids are formed in the simulated fuel pieces, through which apertures simulated smoke may operatively pass.

In a particularly preferred embodiment at least one light source is arranged below the fuel bed.

Preferably said light source and at least some said apertures are so disposed in relation to one another that light from the light source may pass through the apertures thereby to illuminate simulated smoke rising from the simulated fuel bed.

Preferably the apparatus further comprises means disposed below the fuel bed for modifying the colour of light from the light source and/or means disposed below the fuel bed for modifying the intensity of light from the light source.

Preferably a plurality of light sources below the fuel bed are arranged to provide light incident through said apertures at different respective angles.

Preferably the apparatus further comprises control means operative to selectively illuminate said light sources in a random, pseudo-random or other predetermined sequence.

Preferably said means for modifying the colour of light comprises a movable filter having different coloured regions.

Most preferably at least one of said discrete fuel pieces comprises

- first and second parts conjoined to define the external shape of the fuel piece;
- an aperture formed in one of said first and second components;
- a plurality of optic fibres extending from said aperture to points at or near the external surface of the fuel piece between mating faces of the first and second parts such that, when light is transmitted through said optic fibres it is directly visible by a viewer of said external surface.

Preferably said discrete fuel piece is arranged on the fuel bed such that the aperture of the discrete fuel piece is proximate a light source disposed under the fuel bed.

Preferably at least one light source disposed above the fuel bed and operative to illuminate the fuel bed and/or the smoke rising from the fuel bed to provide the illusion of flames.

For a better understanding of the invention and to show how the same may be carried into effect reference will be made by way of example only to the following drawings, in which.

Figure 1:
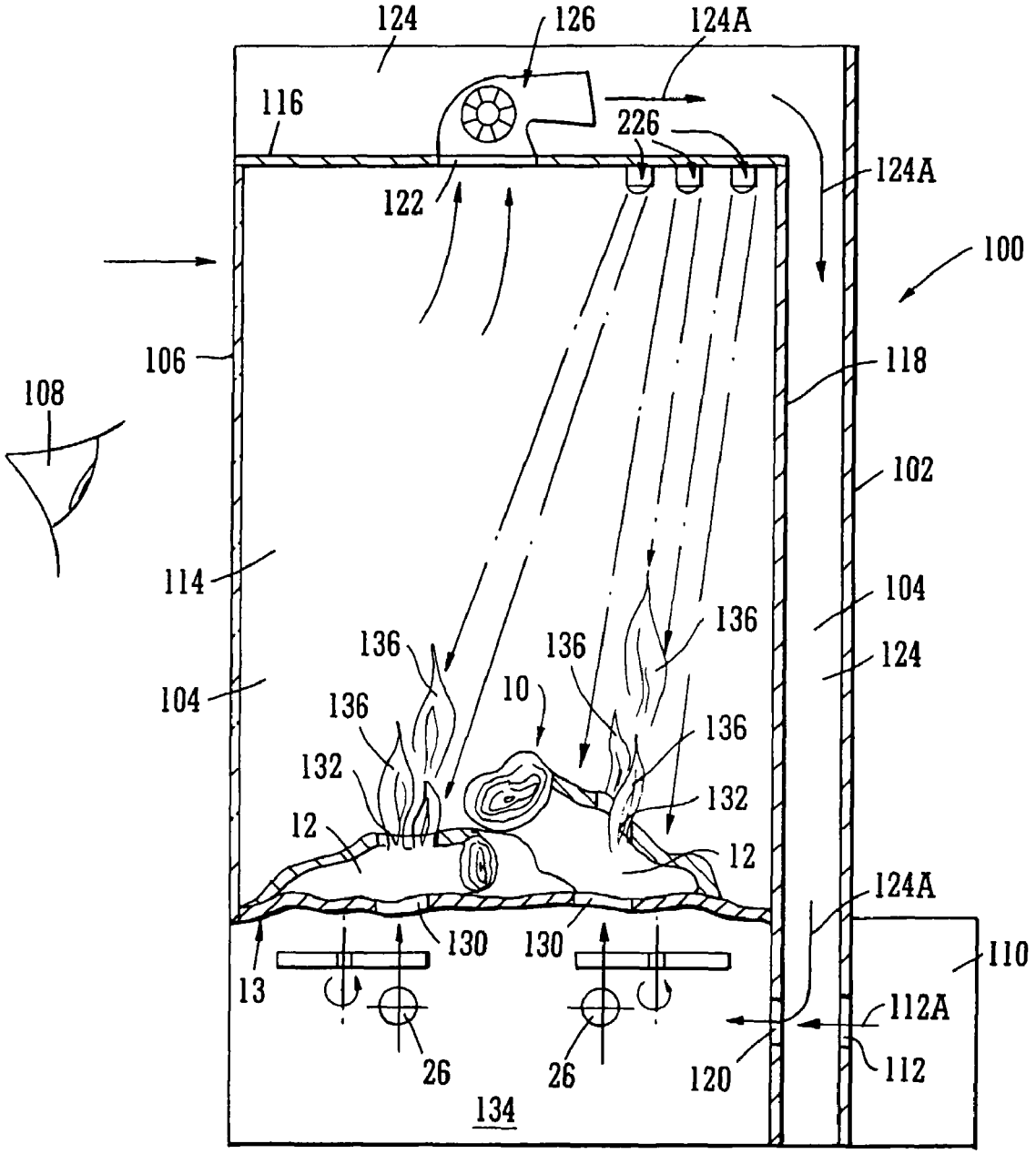
FIG. 1 is a section through a typical apparatus according to the invention.
Figure 2:
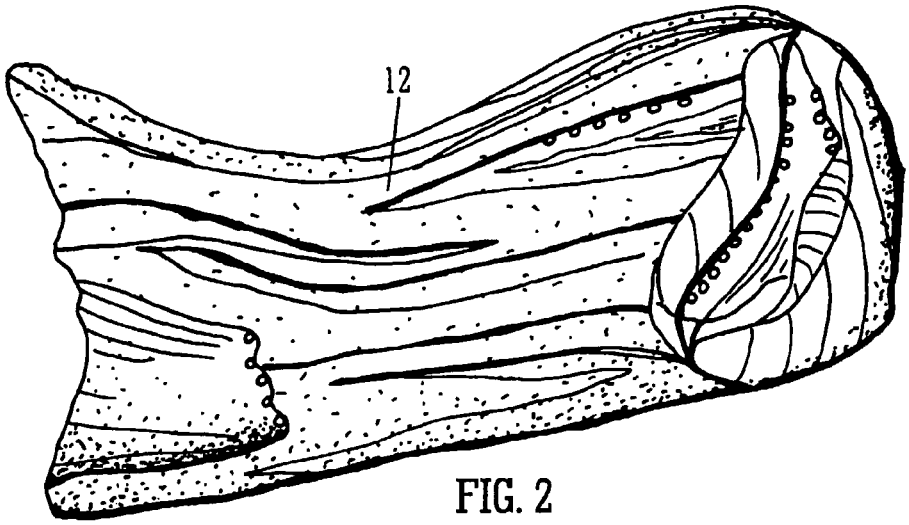
FIG. 2 is a representation of a typical simulated log for a fuel bed of the apparatus according to the invention.

Referring now in particular to FIG. 1, the apparatus 100 of the invention comprises a housing 102 defining a closed chamber 104. The closed chamber 104 has side, rear, top and bottom walls made of a suitable material such as a metal fabrication or a strong plastic material. A major part of the front wall is provided by a transparent screen 106 through which a user 108 may observe the simulated fire effect provided by the apparatus of the invention. The apparatus further comprises a simulated smoke generator 110. Simulated smoke generators are known in the art and typically operate by vaporising a liquid such as a glycol. In the illustrated embodiment, the smoke generator 110 is mounted at the rear of the closed chamber 104. Simulated smoke enters the closed chamber by means of an aperture 112, as indicated by arrow 112A.

Within the closed chamber 104 there is an inner compartment 114 defined by at least one wall. In the illustrated example, the inner compartment is defined by top wall 116 and rear wall 118. Within the inner compartment a simulated ember bed 13 and simulated fuel pieces or elements (in this case, logs) 12 are arranged to simulate a fuel bed. The preferred construction of the fuel pieces 12 is described in more detail below. The logs 12 may include apertures, passageways, voids, channels or the like 132 through which the simulated smoke may pass. Likewise, smoke may pass through gaps between the logs 12, giving the impression of smoke rising from the fuel bed, as in a real fire.

The ember bed 13 is arranged to terminate at the lower edge of the transparent screen 106. Thus, components placed below the ember bed 13 are not visible to a user.

The ember bed 13 also includes apertures 130 which may be aligned with the apertures of the logs 12 and, optionally with the gaps between the logs 12. Apertures may be located directly below the logs 12 so that the smoke is seen by a user to "curl" around the logs 12 in a realistic manner. The inner compartment 114 includes an inlet aperture 120 and an outlet aperture 122. A void 124 is defined between the inner compartment 114 and the walls of the closed chamber 104 and provides a re-circulation pathway for the simulated smoke, as indicated by arrows 124A. A fan 126 is provided in the void 124 (or in any other convenient location not visible to a user) for circulation of the simulated smoke. Thus the circulation path of the simulated smoke is initially from the smoke generator 110 through apertures 112 and 120 into the cavity 134 below the fuel bed 10. The smoke then rises through apertures 130 in the ember bed 13 and through the channels 132 of the logs 12, or around the logs 12. The smoke rises through the inner compartment 114, leaves through outlet aperture 122 and return to inlet aperture 120 through the void 124.

To provide the effect of flames, the smoke is illuminated by one or more light sources. Light sources 26 are disposed below the fuel bed 10 and are described in more detail below. Means for modifying the light from the light sources are also provided, to modify the intensity and/or colour of the light. Such means 34, 36 are also described in more detail below. Light from the light sources 26, as modified by the means 34, 36 passes through the apertures 130 in the ember bed 13. Light also then passes through the channels 132 of the logs 12 and thus illuminates the rising smoke, giving the impression of flames, indicated as 136. Apertures 130 of the ember bed 13, through which light from the light sources may pass may also be aligned with spaces between logs 12, provided that the logs obscure the user's view of such apertures. Such light is also incident on the smoke and gives the impression of flames 136.

Alternatively, or preferably also, one or more light sources 226 are provided at the top of the inner compartment 114. Although conventional incandescent bulbs might provide some effect, preferably the light sources 226 are of a higher intensity, such as halogen bulbs or, more preferably, LEDs or lasers (of suitably low power to meet domestic safety requirements). Ultra bright LEDs are especially suitable. Light from the light sources 226 is directed downwardly at a range of angles towards the simulated smoke rising from the fuel bed and this illumination also gives the impression of flames 136. Preferably electronic control means are provided to illuminate the light sources 226 (and optionally the light sources 26) in a random, pseudo-random or other predetermined sequence. (A pseudo random sequence is a sequence which although not truly random, appears so to an observer). The control means may also vary the intensity of illumination of the light sources 226.

As described, the fuel bed 10 of the invention is provided with a plurality of simulated logs 12. In preferred arrangements, the logs 12 rest on an ember bed 13 which conveniently comprises a plastic moulding shaped and coloured to represent ashes and glowing embers. However, the presence of an ember bed, although desirable is not essential to the invention provided that the construction of the fuel bed is such as to allow simulated smoke to rise through the fuel bed from an unseen source. The logs 12 are laid together, preferably in a predetermined arrangement to closely resemble logs of a solid fuel fire. Various materials may be used for the manufacture of the logs 12, generally as known in the art. For example, techniques are known in the art for producing mouldings from polyurethane or similar foam materials or from coloured or colourless resinous materials. The moulds are constructed to produce logs 12 of the desired shape and the resulting log shapes are painted or otherwise coloured to resemble real logs. The logs 12 may desirably at least partially translucent, or translucent in particular regions, to enhance the impression of glowing, burning logs when illuminated from below. The logs 12 of the invention are shaped to resemble a natural set of logs on a real fire. Preferably, of course, the shapes of the respectively logs are carefully determined so that they sit together securely in a predetermined arrangement which offers the most realistic impression.

Figure 3:
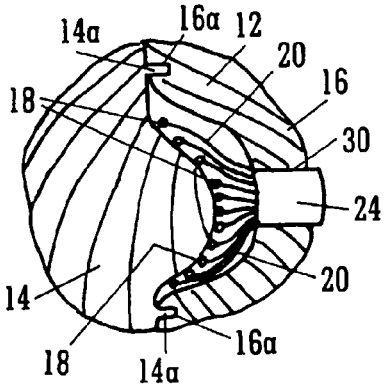
FIG. 3 is a cross section through a typical simulated log for a fuel bed of the apparatus according to the invention.
Figure 6:
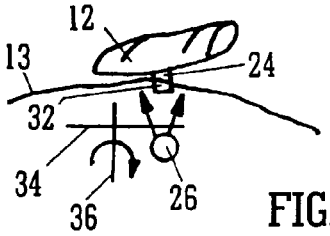
FIG. 6 shows a typical arrangement of a simulated log on an ember bed for the apparatus according to the invention.
Figure 4:
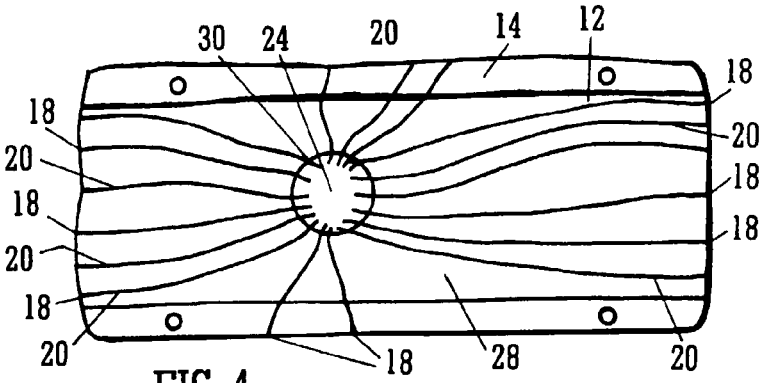
FIG. 4 is a plan view of an inner face of a half-log for use in the fuel bed of the apparatus according to the invention.
Figure 5:
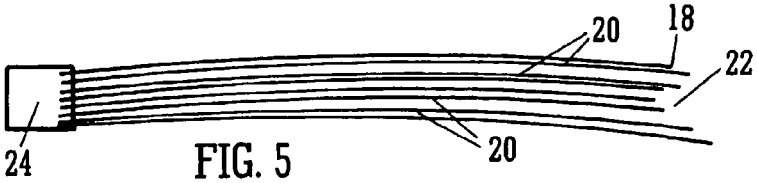
FIG. 5 shows a typical initial arrangement of a group of fibre optic cables for use in the invention.

In preferred embodiments of the invention at least some logs 12 of the invention are formed in two parts, such as an upper part and a lower part or a front part and a rear part. One part 14 of a log 12 is shown in FIG. 4 and front and rear parts 14, 16 are shown together in FIG. 3. The respective parts 14, 16 are joined together in use so that the log 12 appears to be a single entity, that is, so that the join between the respective parts is not readily apparent to a user. The parts 14, 16 may be joined together by any suitable means. In the illustrated example (FIG. 3) co-operating formation are formed on the respective parts 14, 16. Part 14 includes a number of projection 14*a* and part 16 includes corresponding recesses 16*a* which receive the projections 14*a*. In an alternative arrangement, the parts 14, 16 may be adhered together.

Figure 7:
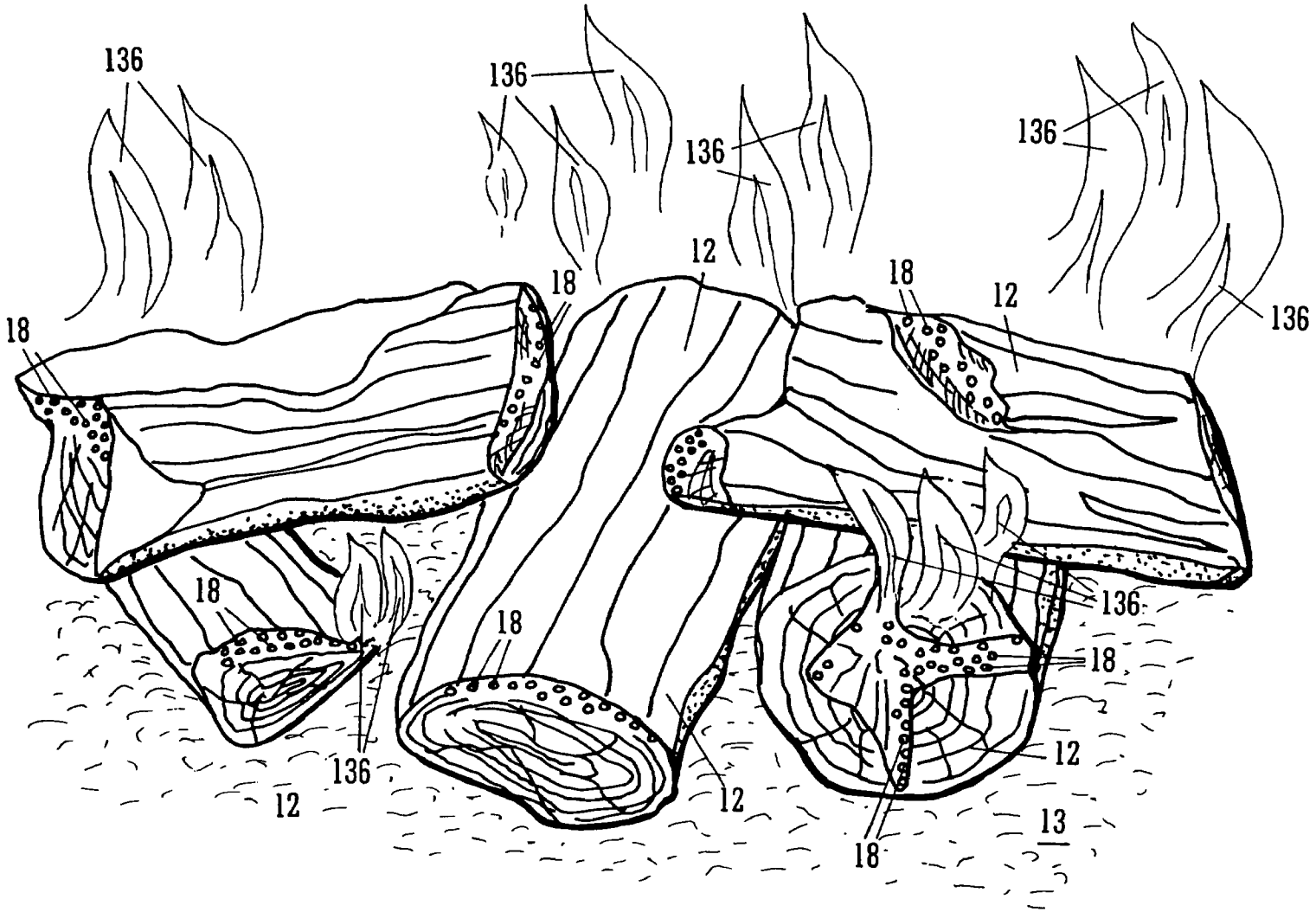
FIG. 7 shows a typical arrangement of a group of simulated logs forming a fuel bed of the apparatus according to the invention.

The logs of the preferred embodiment employ fibre optics to provide an enhanced simulation of a real fire. Ends 18 of the fibre optics 20 are exposed at the surface of the assembled logs 12 so that the ends 18, and the light emitted from the ends 18 may be viewed directly by a user. The two-part construction of the logs 12 enables this arrangement to be achieved. Referring more especially to FIGS. 3 to 6, the fibre optics 20 are arranged into a group or bunch 22 and are gathered together at one end 24 by any suitably permanent means, such as binding with a resin or other cureable material. As will be described in more detail below, the end 24 is arranged in use near to a light source 26. The optic fibres 20 are, of course, flexible. The fibres are arranged over an internal surface 28 of the log part 14, 16 (i.e. on a surface which is not visible when the log 12 is assembled from parts 14, 16) so that they extend to chosen points at or near the outer surface of the part 14, 16. The log 12 assembled from the parts 14, 16 may have a hollow interior and the optic fibres 20 may be disposed along any selected routing within that interior. Thus the fibres 20 terminate at or near the outer surface of the log 12 and, during manufacture may be trimmed to the appropriate length if necessary. If necessary, the optic fibres 20 are secured in their desired locations by any suitable means such as adhesive, stapling, pining, taping with adhesive tape and so on. On assembly of parts 14, 16 to form a log 12, the optic fibres 20 are "sandwiched" between the respective parts 14. Thus the optic fibres 20 are not themselves visible to a user, although their ends 18 are just sufficiently exposed at the junction between the parts 14, 16 to enable light emitted from them to be directly perceived by a user and, if desired to illuminate the smoke rising through the fuel bed to provide the illusion of flames. The parts 14, 16 may be constructed so that the log 12 has a complex external shape including cavities and protrusions, in order to better resemble a real log. The optic fibres 20 may be arranged so that their ends are relatively isolated, or several ends 18 may be grouped together to provide local regions of greater light intensity, such as in said cavities or at said protrusions. Where the fibres 20 terminate at ends 18 within a cavity such as cavity 38 in FIG. 7 the optic fibres 20 may extend beyond the surface of the log 12 (i.e. the surface of the part 14 or 16). Bearing in mind that the log 12 is arranged in use in a specific orientation only the very ends of the fibres may nevertheless be visible to a user.

One side of one of the parts 14, 16 which is not visible to the user when the part 14, 16 is placed on the fuel bed is provided with an aperture 30 through which the fibre optics 20 pass. Conveniently, the end 24 of the bunch 22 of fibre optics 20 may be mounted in the aperture 30. As may be seen from FIG. 6, the end 24 of the optic fibre bunch 22 may also pass through a corresponding aperture 32 in an ember bed 13 (if present). The aperture 32 and the end 24 may be sized to be a friction fit with one another so that they serve to locate the assembled log 12 in its desired location on the fuel bed.

The end 24 of the bunch 22 of optic fibres 20 is arranged in juxtaposition with a light source 26. When the light source is illuminated, light is emitted from the ends 18 of the optic fibres and may be perceived by a user. Most preferably, means are provided for varying the colour and intensity of the light received by the optic fibres 20 over time. Where the light source is a simple source of white or near white light, such as a standard incandescent bulb or halogen bulb, a filter 34 may be disposed between the light source 26 and the end 24 of the optic fibres 20. In the illustrated example, the filter is a translucent disc which includes portions of different colours such as orange, yellow, red green and blue (which are typical colours which may be perceived in a real fire) which are exposed to the light source 26 in sequence. The disc is rotated about its axis 36 by suitable drive means (not shown) which may be an electric motor, for example. In an alternative arrangement, the light source 26 may be mounted within a translucent cylinder which has differently coloured portions. Rotation of the cylinder about its axis causes the differently coloured portions to pass between the light source and the end 24 of the optic fibres 20. In this way, the colour of the light falling on the end 24 of the optic fibres 20 is varied and, consequently the colour of the light emitted by the ends 18 of the optic fibres is varied. The disc 34 or cylinder may include regions which are opaque and/or which are more or less transmissive of light, so that the intensity of the light falling on the end 24 of the optic fibres 20, and emitted form ends 18, is varied.

Mechanical means may also be used for varying the intensity of the light from a light source incident on the end 24. As is well known in the art, so called "spinners" may be mounted above an incandescent light bulb. The spinners are apertured discs which rotate freely about their axis. Heat rising from the light source causes the spinner to rotate. In other arrangements a shaft having a number of approximately radial strips of material depending therefrom may be mounted between the light source 26 and the end 24, with the shaft being rotated about its axis by suitable means such as a motor.

In an alternative arrangement, the end 24 of the bunch 22 of optic fibres 20 may be disposed near an LED (light emitting diode) or a group of LEDs. So-called ultra bright LEDs are also especially suitable in this respect. Where a group of LEDs is provided, the group may preferably include LEDs of different colours. The LEDs may preferably be illuminated under the control of an electronic control means to that variation in the intensity and colour of light falling on the end 24 of the optic fibres 20 is achieved.

The light source 26 need not necessarily be arranged immediately adjacent the end 24. It may be convenient, for example, to use one or more mirrors to direct light from a light source to the end 24 of the bunch 22 of optic fibres 20.

In order to provide further variation in the colour and/or intensity of the light perceived at the ends 18 of the optic fibres 20 a given log 12 may be provided with more than one bunch 22 of optic fibres 20. Each bunch 22 may be provided with its own light source 26 and light intensity and colour varying arrangement.

Although the invention has been described above in relation to a log 12 having two independent parts 14, 16 other constructions which achieve the same or a similar result are not excluded. For example, the ember bed 13 may be shaped and coloured locally to resemble a first (normally lower) part of a log, with an second (upper) part 14 or 16 then being formed independently and mounted directly on the ember bed 13 to form a log 12. In this case, the optic fibres 20 are sandwiched between the part 14 or 16 and the ember bed 13. Also, the parts 14, 16 of forming a log 12 need not be of equal size. For example, an upper part 14 of a log may form the majority of the log with a lower part 16 serving only to form an underside an end portions of the log. Also, the logs of the invention are not confined to only two parts. An upper part 14 may form the majority of a log 12, having for example an outer surface extending between points at the front and rear of the log which a user perceives as resting on the ember bed with two or more parts 16 forming only end faces of the log 12. The optic fibres 20 are still, nevertheless still generally sandwiched between the parts 14 and 16. Any region of a part 14 16 which is not visible to a user in normal use need not be shaped and coloured to resemble a log. For example, the underside of a part 16 may have a plain undecorated surface or may be shaped to conform with an underlying log or with the ember bed.

The present invention has been described in relation to solid fuel elements in the form of logs 12. However, the invention is equally applicable to simulation of other solid fuels such as coal, peat and the like.

The invention claimed is:

1. A simulated burning fuel apparatus comprising:

a simulated fuel bed;

a plurality of smoke apertures defined in the fuel bed through which simulated smoke may pass;

a plurality of colored light sources located below the fuel bed;

a source of simulated smoke provided separate to the plurality of light sources;

means for conveying the simulated smoke from said source through said smoke apertures, so that the smoke rises from said smoke apertures above the simulated fuel bed;

the light sources being configured operatively to direct light onto the smoke rising from said smoke apertures to selectively and/or locally illuminate the smoke rising from the fuel bed, wherein the means for conveying the simulated smoke from said source comprises a fan; and the fan, the plurality of colored light sources and source of simulated smoke are arranged relative to one another such that simulated smoke operably leaves the source of simulated smoke below the fuel bed and prior to being illuminated by the plurality of colored light sources, the color of the colored light sources and the selectively and/or locally illumination of the smoke rising from the fuel bed providing the illusion of flames.

2. An apparatus as claimed in claim 1 further comprising a closed chamber within which the fuel bed, the conveying means and the light sources are arranged.

3. An apparatus as claimed in claim 2 further comprising means for re-circulating the simulated smoke.

4. An apparatus as claimed in claim 3 wherein the closed chamber further comprises an inner compartment within which the fuel bed is mounted, the inner compartment being defined by at least one wall extending within the closed chamber, said wall including at least one smoke inlet aperture and at least one smoke outlet aperture.

5. An apparatus as claimed in claim 4 wherein a duct is defined between at least one wall of the closed chamber and the inner compartment, the duct providing a path for circulation of the simulated smoke from the outlet aperture to the inlet aperture.

6. An apparatus as claimed in claim 4 wherein the means for conveying the simulated smoke is disposed outside the inner compartment.

7. An apparatus as claimed in claim 4 wherein the source of simulated smoke is disposed proximate the inlet aperture of the inner compartment.

8. An apparatus as claimed in claim 7 wherein the source of simulated smoke is sealably mounted on an external face of a wall of the closed chamber, said wall including an aperture arranged proximate the inlet aperture of the inner compartment for entry of simulated smoke into the closed chamber and the inner compartment.

9. An apparatus as claimed in claim 2 wherein the source of simulated smoke is sealably mounted on an external face of a wall of the closed chamber, said wall including an aperture arranged proximate the inlet aperture of the inner compartment for entry of simulated smoke into the closed chamber.

10. An apparatus as claimed in claim 1 wherein the simulated fuel bed comprises a plastic molding shaped and colored to resemble an ember bed, said apertures being formed in the said plastic molding and so located as not to be visible to a user in normal use of the apparatus.

11. An apparatus as claimed in claim 10 wherein the plastic molding is shaped and colored to resemble both an ember bed and pieces of fuel on the ember bed.

12. An apparatus as claimed in claim 1 wherein the simulated fuel bed includes discrete pieces of simulated fuel.

13. An apparatus as claimed in claim 12 wherein the discrete pieces of simulated fuel are arranged on a simulated ember bed.

14. An apparatus as claimed in claim 13 wherein the ember bed comprises a shaped and colored plastic molding.

15. An apparatus as claimed in claim 13 wherein said apertures are formed in the simulated ember bed.

16. An apparatus as claimed in claim 12 wherein further apertures, channels, passages or voids are formed in the simulated fuel pieces, through which apertures simulated smoke may operatively pass.

17. An apparatus as claimed in claim 12 wherein at least one of said discrete fuel pieces comprises:

first and second parts conjoined to define the external shape of the fuel piece;

an aperture formed in one of said first and second components;

a plurality of optic fibres extending from said aperture to points at or near the external surface of the fuel piece between mating faces of the first and second parts such that, when light is transmitted through said optic fibres it is directly visible by a viewer of said external surface.

18. An apparatus as claimed in claim 17 wherein said discrete fuel piece is arranged on the fuel bed such that the aperture of the discrete fuel piece is proximate a light source disposed under the fuel bed.

19. An apparatus as claimed in claim 1 further comprising means disposed below the fuel bed for modifying the color of light from at least one of the light sources.

20. An apparatus as claimed in claim 19 wherein said means for modifying the color of light comprises a movable filter having different colored regions.

21. An apparatus as claimed in claim 1 further comprising means disposed below the fuel bed for modifying the intensity of light from at least one of the light sources.

22. An apparatus as claimed in claim 1 further comprising control means operative to selectively illuminate said light sources in a random, pseudo-random or other predetermined sequence.

23. Apparatus as claimed in claim 1 comprising at least one further light source disposed above the fuel bed and operative to illuminate the fuel bed and/or the smoke rising from the fuel bed to provide the illusion of flames.

24. A simulated burning fuel apparatus comprising:

a simulated fuel bed;

at least one aperture defined in the fuel bed;

at least one light source;

a source of simulated smoke horizontally displaced away from and provided separate to the at least one light source; and means for conveying the simulated smoke from the source of simulated smoke past the at least one light source and through at least one aperture, so that the simulated smoke rises from at least one aperture above the fuel bed;

wherein at least one light source directs light through at least one aperture to operatively selectively and/or locally illuminate the rising simulated smoke above the fuel bed, said at least one aperture defining an optical path between the light source and smoke rising from the fuel bed such that the light passing through said at least one aperture selectively and/or locally illuminates the smoke rising from the fuel bed to provide the illusion of flames above the fuel bed.

* * * * *